United States Patent [19]

Bobick

[11] Patent Number: 4,687,077

[45] Date of Patent: Aug. 18, 1987

[54] PORTABLE MANUALLY OPERATED RESCUE AND LOWERING CABLE

[76] Inventor: John H. Bobick, 6822 Dawson St., Vancouver, BC, Canada, V5S 2W3

[21] Appl. No.: 846,349

[22] Filed: Mar. 31, 1986

[51] Int. Cl.[4] ..... A62B 1/10

[52] U.S. Cl. ..... 182/235; 182/239

[58] Field of Search ..... 182/5, 75, 231, 235, 182/236, 240

[56] References Cited

U.S. PATENT DOCUMENTS

| | | | |
|---|---|---|---|
| 286,523 | 10/1883 | Bemis | 182/240 |
| 529,462 | 11/1894 | Rauk | 182/240 |
| 580,961 | 4/1897 | Steimann | 182/235 |
| 744,094 | 11/1903 | Netcott | 182/240 |
| 2,561,832 | 7/1951 | Wilson | 182/235 |
| 3,217,840 | 11/1965 | Holkesvick | 182/5 |
| 4,205,733 | 6/1980 | Wade | 182/142 |

*Primary Examiner*—Reinaldo P. Machado

[57] ABSTRACT

This specification describes a portable manually operated rescue and lowering device. It consists of a coaster-brake bicycle hub with its flanges extended enough to form a drum to accommodate about 40 meters of fine aircraft cable. To permit hand operation a novel brake securing and releasing lever replaces the standard bicycle sprocket. This modified assembly is mounted into a rigid frame so that the free end of the cable proceeds up away from the hub to be secured to a building part or object within the building. A fastener for hooking onto a sling is hung from the frame by means of a cable--the length of which is correct for holding a user within easy reach of the brake securing and releasing lever. With this lever, the operator can cause the cable to unwind quickly or slowly or to brake to a complete halt. To prevent the cable from accidentally unwinding constant counterclockwise tension is provided to the lever by two springs. The object of this invention is to provide a simpler, easier to operate device by means of which persons or objects can be manually lowered to safety in an emergency such as from a burning building. Another object is to make this device easily affordable, lighter and so compact that it might soon come into general use.

1 Claim, 7 Drawing Figures

Fig. 1
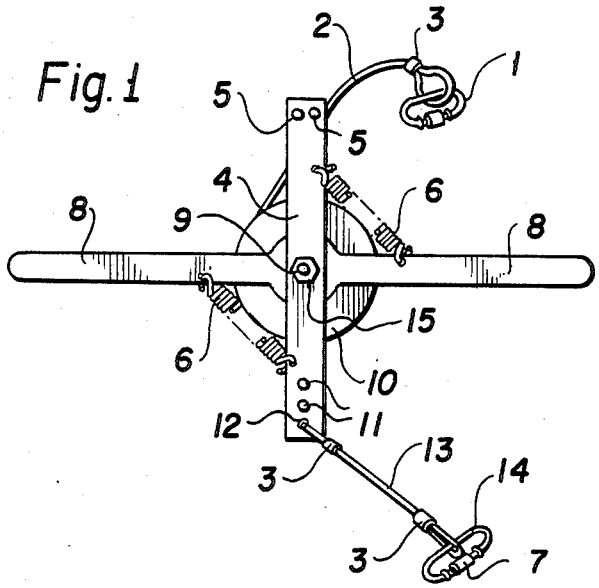
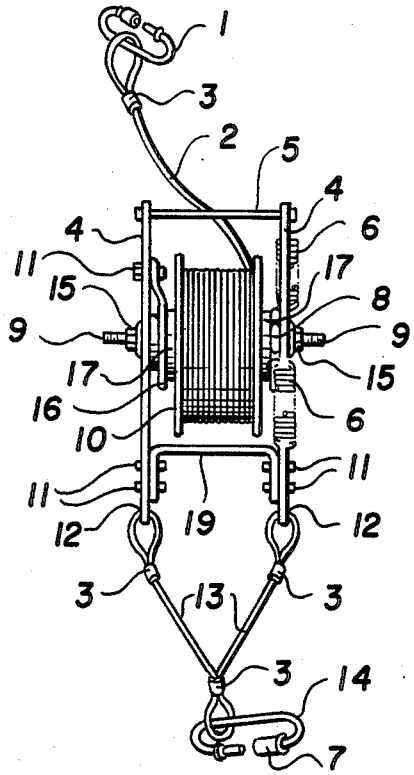
Fig. 2

FIG. 3
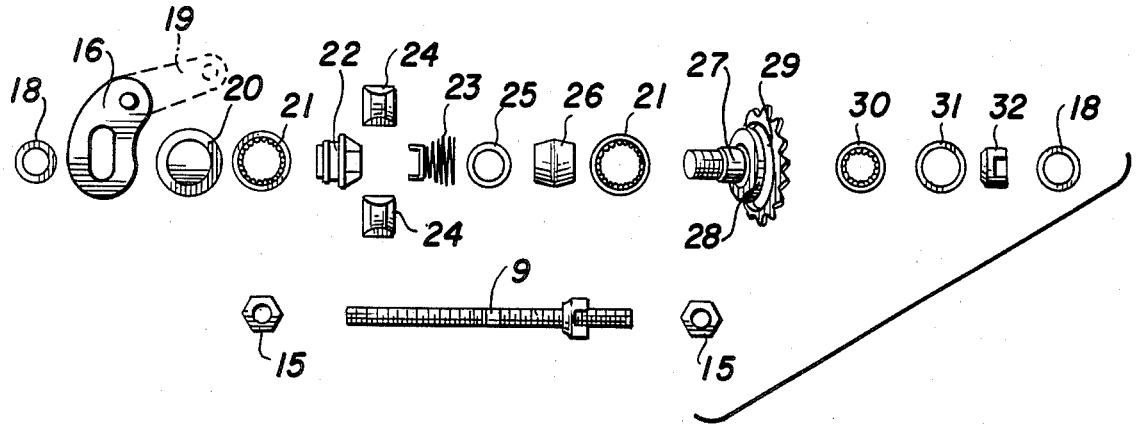
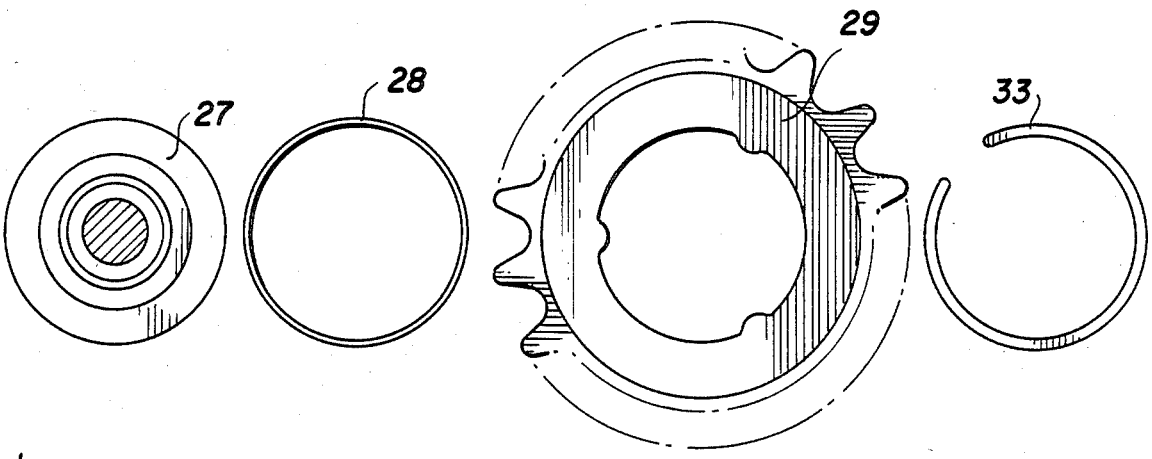
FIG. 4
FIG.5
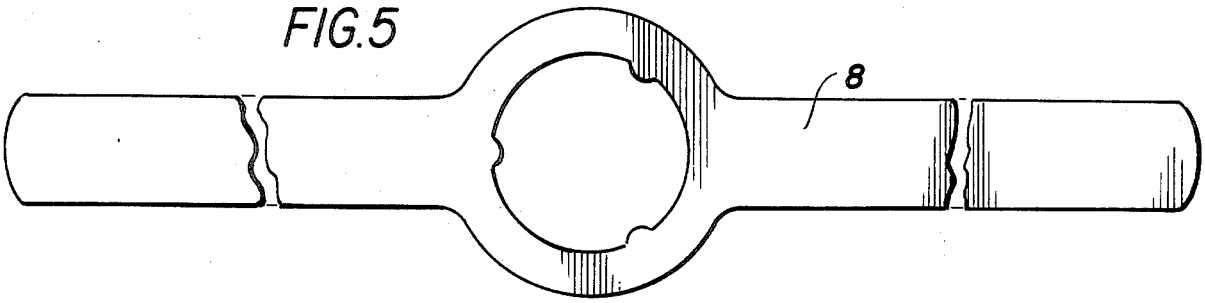

FIG. 6
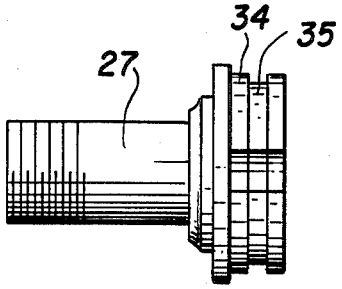
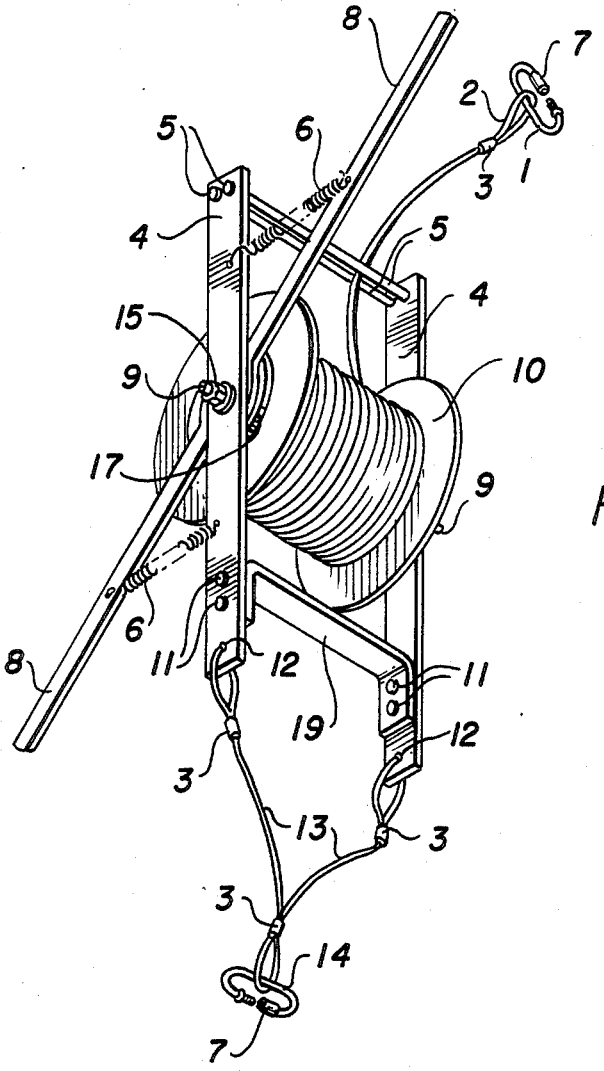
FIG. 7

PORTABLE MANUALLY OPERATED RESCUE AND LOWERING CABLE

SUMMARY OF THE INVENTION

This invention relates to a portable manually operated rescue and lowering cable for lowering oneself, others or objects from one level to another in an emergency situation.

It is common in manually operated rescue and escape devices to include a housing containing a drum about which a cable is coiled. In use, one lowers himself from danger—the free cable end being anchored at the point of departure while he, secured in a sling attached to the escape device housing, descends to safety, his rate and distance of descent being controlled by a braking mechanism which acts upon the cable drum during descent. I understand that various similar devices have been patented; however, I do not know of any that have come into common use. I believe this is because they may have been too large, heavy or cumbersome to be easily carried in a small suitcase, zipper bag or briefcase, and, or because they are too expensive to buy in the first place.

I believe that these disadvantages may be overcome by making a coaster-brake bicycle hub serve as both cable drum and brake at the same time by extending the hub flanges far enough to create a drum for the cable and by replacing the coaster-brake sprocket with a lever to provide "by-hand" control to obtain "within-the-hub" braking action as required. Housed in a small simply constructed frame, this novel arrangement and adaptation combine to produce a very light and unusually small and inexpensive lowering device—thereby overcoming the disadvantages referred to above.

BRIEF DESCRIPTION OF THE DRAWINGS

FIG. 1 is viewed from the front as its operator would see it during self-lowering.

FIG. 2 is the device in the same position as in FIG. 1, but viewed from its side.

FIG. 3 is a view of the components contained in a typical coaster-brake bicycle hub.

FIG. 4 is an enlarged actual-size broken-down view of the driver 27 assembly shown in FIG. 3.

FIG. 5 is a plan view of the brake securing and releasing lever which takes the place of the sprocket shown in FIG. 4.

FIG. 6 is a side view of driver 27.

FIG. 7 is a perspective view of the cable device.

DESCRIPTION OF THE PREFERRED EMBODIMENT

The preferred embodiment illustrated is not intended to be exhaustive nor to limit the invention to the precise form disclosed nor to designate the particular coaster-brake assembly to be utilized. It has been chosen and described in order to best explain the principles of the invention and its application and practical use to thereby enable others skilled in the art to best utilize the invention.

The lowering device comprises a cable-holding coaster-brake bicycle hub assembly mounted in a metal frame to which is attached a cable and clasp for holding a body sling. FIG. 3 represents a typical coaster-brake bicycle hub assembly with axle 9 accommodating, from left to right, axle nut 15, washer 18, shortened brake arm 16, dust cap 20, ball retainer 21, brake cone 22, brake shoes 24, clutch spring & washer 23, clutch washer 25, clutch cone 26, ball retainer 21, driver 27, dust cap 28, sprocket 29, ball retainer 30, dust cap 31, cone 32, washer 18 and nut 15.

When assembled, driver 27 engages within clutch cone 26, its grooves sliding within accommodating grooves inside of the said clutch cone. Accordingly, any counterclockwise turning of driver 27 results in clutch cone 26 being forced to the left where it rides under brake shoes 24, forcing them apart and to bear strongly against the inside wall of hub 17, thus producing braking at the interior of the said hub. And, clockwise turning of the said driver releases braking and allows the cable drum to turn and cable 2 to unwind from said drum.

FIGS. 4 and 6 show driver assembly with sprocket retaining spring 33 removed from retainer spring recess 35, and sprocket 29 and dust cap 28 from support platform 34.

FIG. 5 shows brake securing and release lever 8 which replaces sprocket 29 and provides means for hand control of braking.

In operation the aircraft control cable 2 which is wound onto hub 17 with its free end passing between guide bolts 5 is run around a retaining object and hooked onto itself with fastener 1. Tensioning springs 6 maintain braking inside of hub 17, preventing it from turning by exerting counterclockwise force on the driver 27 through the brake securing and releasing lever 8, the said lever being connected by the said springs to frame sides 4. The device user then hooks clasp 14 to his body sling or support, the said clasp being connected to sling support cable 13 which in turn connects to the lower ends of frame sides 4 through holes 12. The device frame is rendered rigid by means of four bolts 11 which fasten metal member 43 to frame sides 4 immediately beneath extended hub flanges 10 and at the top by two long guide bolts 5 immediately above said hub flanges 10.

To begin descent the device user exerts clockwise force with the two hands at the ends of both sides of the brake securing and releasing lever 8. When this clockwise force lessens, the counterclockwise tension being exerted by springs 6—cable 2 release from hub 17 commences. To decrease or stop his rate of descent the user reduces or ceases applying clockwise force to said lever 8.

The user can lower objects or persons with this device by securing clasp 14 to a retaining object or building and connecting the free end of cable 2 by means of fastener 1 to the object or person to be lowered. Then, by operating the brake securing and releasing lever 8 the user can cause the cable 2 to unwind, so effecting lowering.

Fasteners and clasps with screw type securing sleeves 7 are used to guard against accidental unfastening and metal press sleeves 3 are used as cable connectors for greater cable security.

It is to be understood that the invention is not to be limited to the details given above; but may be modified withing the scope of the claims.

The embodiments of the invention in which I claim an exclusive property or privilege are defined as follows:

1. A portable manually operated rescue and lowering cable device for emergency descent from a building comprising in combination, a cable the free end of which is adapted to be secured at the point of origin of the descent, a coaster brake bicycle hub assembly with its hub flanges extended so as to provide a reel upon which the said cable is wound, the said hub assembly being fitted with a brake securing and releasing lever in place of the sprocket so as to realize hand-activated braking action, a metal frame in the side bars of which the said hub assembly is journaled, comprising the said pair of said bars which are rigidly held in place with a metal bar at one extremity and at the opposite with two guide bolts between which the free cable-end passes, a sling support cable secured to the ends of the said frame distant from the said guide bolts for attachment to a body sling for self-descent by the said device operator or for attachment at the point of origin from where another person or object may be lowered by an operator located at the said point of origin, a pair of springs attached at one end to the said frame and at the other to the said lever to prevent the said reel from turning till the operator of the said device desires descent and with his hands applies clockwise brake releasing force to the said lever, the amount of said releasing force being applied varying with the rate of descent speed desired.

* * * * *